United States Patent [19]

Sakaoka et al.

[11] Patent Number: 4,521,126

[45] Date of Patent: Jun. 4, 1985

[54] MECHANICAL PENCIL

[75] Inventors: Gouji Sakaoka, Kawasaki; Takashi Ishikawa, Toride, both of Japan

[73] Assignee: Pentel Kabushiki Kaisha, Tokyo, Japan

[21] Appl. No.: 408,719

[22] Filed: Aug. 16, 1982

[30] Foreign Application Priority Data

| | | | |
|---|---|---|---|
| Aug. 31, 1981 | [JP] | Japan | 56-129024 |
| Oct. 21, 1981 | [JP] | Japan | 56-156775 |
| Oct. 21, 1981 | [JP] | Japan | 56-156776 |

[51] Int. Cl.[3] ..... B43K 21/16; B43K 21/22

[52] U.S. Cl. ..... 401/65; 401/67; 401/81; 401/94

[58] Field of Search ..... 401/53, 65, 67, 80, 401/81, 94

[56] References Cited

U.S. PATENT DOCUMENTS

| | | | |
|---|---|---|---|
| 1,969,085 | 8/1934 | Leistenschneider et al. | 401/67 |
| 2,385,442 | 9/1945 | Hoffman | 401/67 |
| 4,180,339 | 12/1979 | Katz | 401/65 X |

FOREIGN PATENT DOCUMENTS

| | | | |
|---|---|---|---|
| 1066103 | 9/1959 | Fed. Rep. of Germany | 401/67 |
| 2837586 | 3/1980 | Fed. Rep. of Germany | 401/65 |
| 2921875 | 12/1980 | Fed. Rep. of Germany | 401/67 |
| 1202796 | 1/1960 | France | 401/94 |

*Primary Examiner*—Steven A. Bratlie

*Attorney, Agent, or Firm*—Wenderoth, Lind & Ponack

[57] ABSTRACT

A mechanical pencil includes a lead engaging collet biased rearwardly, a collet receiver tube having a tapered guide face and rolling elements mounted between the tapered guide face and the collet for inducing a clamping force against a writing lead. The pencil includes a device for advancing the collet receiver tube and the collet toward a pencil tip and then permitting the collet receiver tube alone to move rearwardly. This assures that the inner elements will step the lead an increment from the pencil tip for writing purposes.

4 Claims, 8 Drawing Figures

MECHANICAL PENCIL

BACKGROUND OF THE INVENTION

The present invention relates generally to a mechanical pencil, and more particularly to a mechanism mounted therein for advancing a slit collet chuck with the lead gripped therein and for retracting the collect chuck with releasing the grasping force of the collect chuck against the lead and upon the lead being projected or stepped a tiny increment from a pencil tip.

A generally known pencil of the type described has a feed tube with jaws for grasping the lead, or a slit collet chuck having a recess for receiving balls and a chuck actuation cylinder having a tapered surface for engaging with the balls to induce a "wedging" function to releasably grasp the lead within the slit collet. In order to achieve a smooth actuation of the inner mechanism for advancing the lead so that the lead is placed forward to a writing position, the chuck actuation cylinder mounted around the collet chuck is first advanced towards the pencil tip with its grasping force being unchanged by means of the wedging function, and then the collet chuck is further displaced forwardly relative to the position of the chuck actuation cylinder to permit the chuck to open to release the grasping force of the collect chuck against the lead. In the known structure, however, when the collect chuck is retracted to its original closed position the radially outwardly opened collet chuck is likely to be first closed and then retracted longitudinally to the original normal position. Accordingly, there are cases and happenstances in which the projected lead accompanies by the retraction of the collet chuck, and therefore, the tiny increment of the lead is again pulled into the pencil, resulting in loss of the increment of the lead. Further, in the known pencil, there is a disadvantage that the collet chuck is not fully opened or moved radially outwardly so as to completely release the grasping force thereof against the lead, and therefore the lead is not fed fully into the pencil tip, and any one of spare leads housed within the pencil is not fully advanced into the collet chuck and into the pencil tip.

SUMMARY OF THE INVENTION

An object of the present invention is to provide an improved mechanical pencil with a simple structure.

A further object of the invention is to provide a new mechanical pencil which permits a positive retraction of the chuck actuation cylinder relative to the slit collet chuck.

Another object of the invention is to provide a novel mechanical pencil which assures a forward movement of the lead to project from a pencil tip for writing purposes.

Briefly, a mechanical pencil according to the present invention comprises a lead engaging collet made of spring material normally biased to spring open from clamping engagement with lead, a collet receiver tube having a guide face tapering in a direction away from a pencil tip, rolling elements mounted between the guide face and the collet for inducing a clamping force against the lead when the collet receiver tube is advanced relative to the collet, first spring means for biasing the collet rearwardly relative to the collet receiver tube, second spring means for biasing the collet receiver tube relative to a pencil body or casing, means for advancing the collet along with the collet receiver tube with the collet being closed to grasp the lead, and then permitting the collet receiver tube to retract independently from the collet.

PREFERRED EMBODIMENTS OF THE INVENTION

Figure 1:
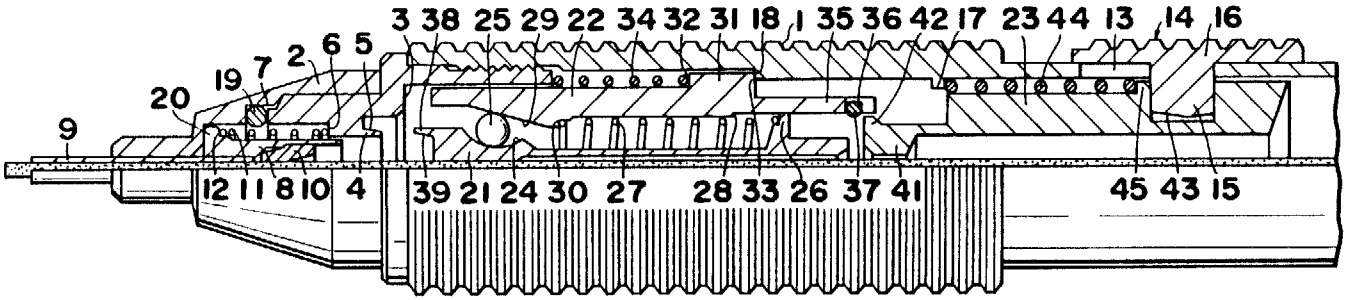
FIG. 1 is a partly sectional elevation of a mechanical pencil embodying the invention, showing the elements in a general condition for writing purposes.

Referring first to FIG. 1 in the drawings, the reference numeral 1 designates a tubular pencil casing for housing the operation parts of the pencil mechanism. The casing 1 is provided at one end with a conical point tip piece 2 which is releasably connected to such end of the casing by a screw thread as illustrated, or by any other technique such as a press-fit, to form a pencil tip portion. The conical tip piece 2 has an abutment face 3, a rearward projection 4 having a rearwardly tapered surface 5, a shoulder 6 facing opposite to the projection 4, and an annular recess 7 for mounting therein an elastomeric ring 19. The conical tip piece is centrally apertured and has a bore within which is longitudinally slideably provided a centrally apertured slider 8 having a pipe 9 projecting forwardly from the tip piece 2 and a lead retainer 10 formed preferably of an elastomeric ring. The pipe 9 and the lead retainer 10 are fixed inside the slider 8. The slider 8 is biased forwardly by means of a helical spring 11 one end of which is received by a shoulder 12 of the slider and the other end by the shoulder 6 of the tip piece 2. The slider has at its front end an annular projection 20 which is frictionally engageable with the elastomeric locking ring 19.

The casing 1 which is releasably engaged with the tip piece 2 has a plurality of indentations on the outer surface so as to provide a desired styling and appearance as illustrated, and a longitudinal slot 13 into which an actuation button 14 is disposed. The button 14 has a rod 15 projecting into the casing 1, and an outer portion 16 longitudinally extending along the outer surface of the casing such that the button 14 is slideable longitudinally along the longitudinal slot 13. The casing has a flat area adjacent to the front and rear ends of the slot 13 so that the button 14 is slideable on the flat area without any obstructions. The outer portion 16 of the button is provided with a plurality of indentations as illustrated, for facilitating a manual actuation or a frictional contact with a finger of a user and for styling purposes.

The casing has on its inner surface a flange 17 projecting inwardly and an abutment shoulder 18, the functions of which will be described presently. Though not shown in the drawing, the casing is closed or plugged at its rear end by a conventional eraser.

Within the casing there are provided a lead feed mechanism having a lead engaging collet 21 of known structure having split collars or jaws made of spring material normally biased to spring open from clamping engagement with the lead therein, a collet receiver tube 22, and a cylindrical pusher 23 engaged with the button 14 to displace the collet 21 and the collet receiver tube 22 forwardly.

The lead engaging collet 21 has a forward projection 38 having a forwardly tapered inner surface 39, a recess 24 on opposite sides thereof, one of which is shown, for nesting therein a ball 25 and a longitudinal tubular portion having an outwardly projecting shoulder 26 for receiving a rear end of a helical spring 27 and for limiting the forward displacement of the collet 21 relative to the collet receiver tube 22 by abutment with an inwardly projecting shoulder 28 formed on the collet receiver tube 22.

The collet receiver tube 22, which is mounted around the collet 21 with a certain annular space therebetween, has a inclined guide face 29 tapering rearwardly and away from the pencil tip, a shoulder 30 for receiving a front end of the spring 27 which is mounted around the lead engaging collet 21. The spring 27 biases the collet 21 rearwardly relative to the collet receiver tube 22. The collet receiver tube 22 is also provided with a flange 31 for forming a front shoulder 32 and a rear shoulder 33 for limiting the rearward displacement of the tube 22 by abutment with the shoulder 18 of the casing 1. Between the front shoulder 32 of the collet receiver tube 22 and the rear end of the tip piece 2, there is disposed a helical spring 34 which biases the collet receiver tube 22 rearwardly to abut against the shoulder 18 of the casing 1. The collet receiver tube 22 has a rearwardly projecting tubular portion 35 having an annular recess 36, within which is received an annular member 37 such as an O-ring of rigid material or an elastomeric ring, partly projecting inwardly from an inner surface of the rear portion 35.

The cylindrical pusher 23, which is also mounted within the casing 1 at the rear of the lead engaging collet 21, has a front portion 41 having a rim 42 projecting outwardly so as to frictionally engage with the annular member 37 mounted to the rear portion 35 of the collet receiver tube 22. The cylindrical pusher 23 has a hole 43 into which the rod 15 of the button is press-fitted so that actuation of the button 14 provides a longitudinal movement of the pusher 23. The reference numeral 44 represents a helical spring mounted around the pusher 23 between the flange 17 of the casing 1 and an outwardly projecting shoulder 45 formed adjacent to the recess 43. The spring 44 biases the pusher 23 rearwardly relative to the casing 1 so that the button 14 is normally placed into a rearwardmost or fully retracted position towards the rear end of the pencil.

Figure 2:
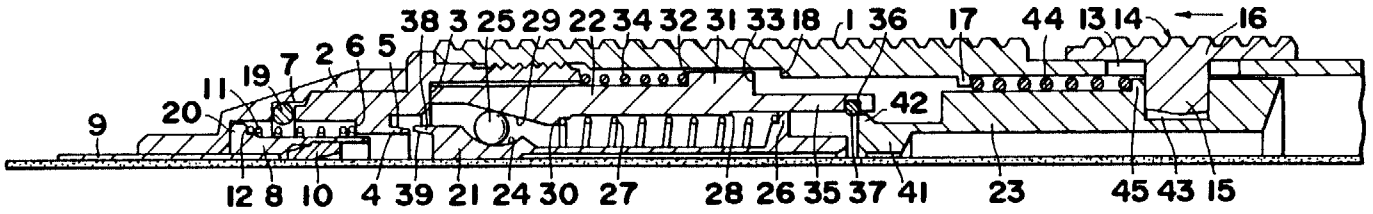
FIGS. 2 and 3 are sectional views of a part of the pencil shown in FIG. 1, showing an operational mode of the pencil.
Figure 3:
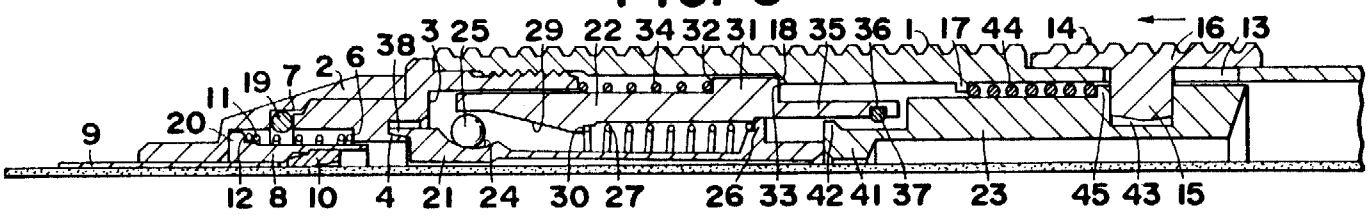

An operation of the inner mechanism of the pencil will be described with reference to FIGS. 1, 2 and 3. FIG. 1 shows the inner mechanism positioned in a normal position in which the lead is firmly held by the clamping force of the collet, the clamping force being induced by a "wedging" action by means of the collet 21, collet receiver tube 22 and balls 25.

When the lead tip projecting from the slider pipe 9 is worn during writing, or when the lead is advanced fully to project from the pipe 9 for writing purposes, the button 14 is manually operated so that it slides along with the pusher 23 against the force of the spring 44 longitudinally forwardly along the pencil casing 1 so that the rim 42 of the pusher 23 contacts the annular member 37 of the collet receiver tube 22. A further forward movement of the button 14 advances the collet receiver tube 22 by the engagement between the annular member 37 and the rim 42 to strengthen the clamping force of the collet 21 against the lead, and simultaneously results in the advance of the collet 21. Thus, the collet receiver tube 22 is forwardly displaced along with the collet 21 with the lead gripped therein until the collet receiver tube 22 abuts against the abutment face 3 of the conical tip piece 2, as shown in FIG. 2.

When the button 14 is further operated to move the pusher 23 forwardly against the frictional resistance between the annular member 37 and the rim 42 of the pusher, the rim 42 rides over the annular member 37 to permit the collet receiver tube 22 to immediately displace reawardly by means of the spring 34, and on the other hand, the front end of the pusher 23 contacts against the rear end of the collet 21 and pushes the collet 21 in the forward direction towards the conical tip piece 2 until the forward projection 38 of the collet 21 slides over the projection 4 of the conical tip piece 2 such that the tapered surface of the collet 21 is positioned on the tapered surface 5 of the projection 4. Thus, the collet is fully opened as illustrated in FIG. 3. When the pressure imparted to the button 14 is released, the pusher 23 is retracted to its original position by means of the spring 44, and simultaneously, the collet 21 is retracted by means of the spring 27 to its original position, as illustrated in FIG. 1. The collet, when retracted, firmly grasps again the lead therein for writing purposes, FIG. 1.

FIGS. 4A through 4E show modified forms of the device (37, 42) which functions to advance the collet receiver tube 22 along with the collet 21 with the collet being closed to grasp the lead so that the lead is advanced an increment for writing and functions to permit the advanced collet receiver tube to retract alone to its initial position.

Figure 4A:
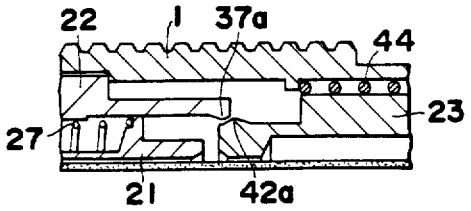
FIGS. 4A, 4B, 4C, 4D and 4E are sectional views of parts of the elements, showing different modifications of the structure.

In FIG. 4A, the collet receiver tube 22 has at its rear end a lug 37*a* projecting inwardly towards the axis of the pencil casing 1, and the pusher 23 has at its forward end a lug or rim 42*a* projecting outwardly, similar as the rim 42 of the embodiment of FIG. 1. The other structures and operation of the inner mechanism such as, for example, the collet 21 are similar to those of the embodiment of FIG. 1.

Figure 4B:
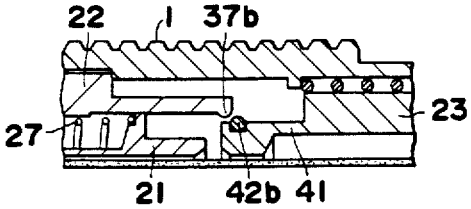

FIG. 4B shows a further modification in which the collet receiver tube 22 has a lug 37*b* as similar to the embodiment of FIG. 4A, and the pusher 23 has at its forward end portion an elastomeric ring 42*b* mounted in an annular recess 46 formed around the front portion 41 of the pusher 23 so that the lug 37*b* can frictionally engage with the ring 42*b*.

Figure 4C:
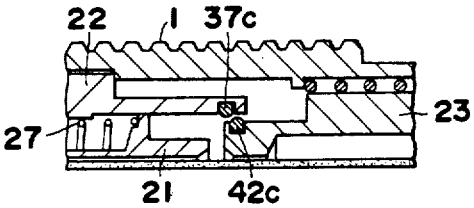

FIG. 4C shows another modification in which both the collet receiver tube 22 and the pusher 23 have elastomeric rings 37*c* and 42*c*, respectively, so that the rings 37*c*, 42*c* can be frictionally engaged with each other.

Figure 4D:
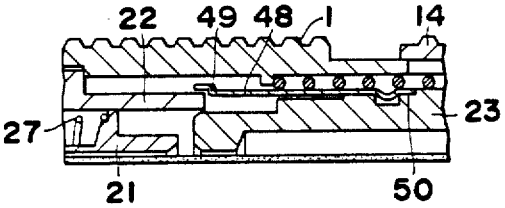

In FIG. 4D, the pusher 23 has at least a single resilient member 48 made of, for example, a leaf spring extending towards the collet receiver tube 22. The resilient member 48 has an abutment shoulder 49 at its forward end portion and is fixed at its rear end to the pusher 23 at 50 so that the shoulder 49 can contact with the rear end of the collet receiver tube 22 to move the latter forwardly. If a thrust is continuously added to the pusher 23 by means of the actuation button 14 (FIG. 1) after the front end of the collet receiver tube 22 abuts against the abutment face 3 of the conical tip piece 2 (FIG. 1), the resilient member 48 will be outwardly displaced by its resiliency to release the engagement between the shoulder 49 and the collet receiver tube 22. Other structure as well as the operation of the inner mechanism are substantially similar to those of the embodiment of FIG. 1, and a further description will not be made. Though not shown the resilient member 48 may be fixed to the collet receiver tube 22 so that the shoulder 49 faces rearwardly, and a shoulder can be formed on the pusher 23.

Figure 4E:
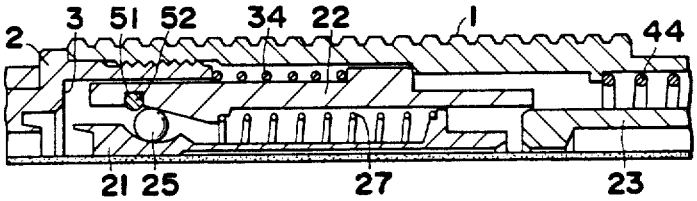

FIG. 4E shows a further modification in which the collet receiver tube has at its inner front end portion an annular recess 51 for mounting therein an O-ring 52, which is designed to be positioned immediately in front of the ball 25 and to partly project inwardly so that the O-ring 52 can frictionally engage with the ball 25 received by the collet 21. In this enbodiment, the actuation of the button 14 (FIG. 1) advances the pusher 23 against the resilient force of the spring 44 to directly advance first the collet 21 and immediately thereafter the collet receiver tube 22 by the engagement of the ball 25 and the O-ring 52 of the collet receiver tube 22 until the tube 22 abuts against the face 3 of the conical tip piece 2. After the forward movement of the collet receiver tube is limited by the abutment as described, a further actuation of the button 14 (FIG. 1) advances the collet 21 so that the balls 25, only one of which is shown for clarification, ride over O-ring 52 to permit the collet receiver tube 22 to immediately retract to its original position. Other structure of the elements and operations can be understood to be substantially similar with those of the previous embodiments, and a further description will not be made.

With reference again to FIGS. 1 and 3, a slider locking mechanism for carriage of the pencil, for example in the user's pocket, is explained. After the actuation button 14 is completely operated so that the collet 21 is advanced fully and radially outwardly moved or opened widely to release its grasping force against the lead as shown in FIG. 3, the pencil tip is pushed down against a flat object such as a table or the like, with the force imparted onto the button 14 being maintained to keep the collet 21 fully opened, so that the lead is retracted against the frictional resistance force of the lead retainer 10 until the front end of the lead is flush with the front end of the pipe 9. Then the slider 8 is retracted by pushing continuously the pencil tip against the flat object until the front end of the pipe 9 is substantially flushed with the front end of the conical tip piece 2, and the slider 8 is locked, by frictional engagement between the ring 19 and the projection 20, in position within the conical tip piece 2 of the pencil casing 1 to protect the lead as well as the pipe 9. When the actuation thrust manually imparted to the button 14 is released, the collet 21 is retracted to its original position to produce again a grasping force against the lead. Thereafter, if the button 14 is actuated again for writing purposes, the collet 21 is advanced into collision with the rear end of the slider 8 to forcibly release the frictional engagement between the locking ring 19 and the slider 8. Thus, the slider 8 is advanced by the spring force of the spring 11 to step the lead forward an increment from the front end of the pipe 9. Accordingly, the slider locking mechanism has an additional function to advance the lead for writing purpose as well as the function of lead protection.

In order to assure an accurate positional relation between the collet 21 and the collet receiver tube 22, longitudinal grooves (not shown) can be formed on the inclined guide surface 29 of the collet receiver tube 22 for rotatably securing the circumferences of the balls 25 other than the portions received by the recess 24 of the collet 21. Provision of the grooves as described can prevent the collet 21 from unwillingly rotating relative to the collet receiver tube 22. This also prevents the lead from being broken due to undesired rotational movement of the collet even though a shock or undesired thrust is applied to the pencil.

Though the present invention has been described with reference to the preferred embodiments, many modifications and alterations may be made within the spirit of the invention. For example, in place of the sliding button 14 mounted slideably on the outer surface of the casing 1, a general type of push button, not shown in the drawing, may be placed on the rear end of the casing 1 so that a manual depression of the push button towards the pencil tip can advance the pusher 23.

What is claimed is:

1. A mechanical pencil comprising:

a tubular casing;

a centrally apertured conical tip piece connected to an end of said casing to form a pencil tip, said tip piece having therein a sleeve projecting longitudinally from said tip piece and a lead retaining ring for frictionally holding the lead therein;

a lead engaging collet normally biased to spring open from clamping engagement with the lead, said collet being longitudinally movably mounted within said casing, said collet having recesses for securing rolling elements;

a collet receiver tube longitudinally movably mounted within said casing, said collet receiver tube having a tapered guide surface for said rolling elements, said guide surface tapering inwardly in a direction opposite to said pencil tip such that movement of said collet receiver tube in a first direction towards said pencil tip relative to said collet induces a lead gripping force of said collet against the lead;

first spring means for biasing said collet rearwardly in a second direction opposite to said first direction relative to said collet receiver tube;

second spring means for biasing said collet receiver tube rearwardly in said second direction relative to said casing;

an actuation button means mounted on said casing;

a cylindrical pusher means longitudinally movably mounted within said casing for advancing said collet and said collet receiver tube towards said pencil tip, said pusher means being connected to said actuation button means;

third spring means for biasing said pusher means rearwardly in said second direction;

engagement means for causing said collet and said collet receiver tube to advance together in said first direction towards said pencil tip until said collet receiver tube abuts against a part of said casing when an axial thrust is applied through said button means to said pusher means, and for causing said collet to advance further in said first direction after the forward movement of said collet receiver tube is restricted by such abutment, while enabling said collet receiver tube to be moved by said second spring means in said second direction when the forward thrust is continued, thereby preventing said collet receiver tube from drawing the lead back into the casing upon release of the forward thrust, said engagement means comprising a first friction projection extending inwardly from said collet receiver tube towards an axis of said casing, and a second friction projection extending from said pusher means outwardly from said axis of said casing, said first friction projection being frictionally engageable with said second friction projection when said pusher means is advanced towards said pencil tip; and said conical tip piece having a rearwardly projecting portion having a rearwardly tapered outer surface, and said collet having a forwardly projecting portion having a forwardly flared inner surface, whereby when said collet is fully advanced towards said pencil tip, said projecting portion of the collet slides on said outer surface of said projecting portion of the conical tip piece so that said collet is opened to permit a new lead to be dropped through the opened collet.

2. A mechanical pencil as claimed in claim 1, wherein at least one of said friction portions is an elastomeric ring.

3. A mechanical pencil as claimed in claim 1, wherein said sleeve is axially slideably mounted within said conical tip piece, and said conical tip piece has an elastomeric ring for frictionally engaging said sleeve to lock said sleeve is position within said conical tip piece.

4. A mechanical pencil comprising:

a tubular casing;

a centrally apertured conical tip piece connected to an end of said casing to form a pencil tip, said tip piece having therein a sleeve projecting longitudinally from said tip piece and a lead retainer ring for frictionally holding the lead therein;

a lead engaging collet normally biased to spring open from clamping engagement with the lead, said collet being longitudinally movably mounted within said casing, said collet having recesses for securing rolling elements;

a collet receiver tube longitudinally movably mounted within said casing, said collet receiver tube having a tapered guide surface for said rolling elements, said guide surface tapering inwardly in a direction opposite to said pencil tip such that movement of said collet receiver tube in a first direction towards said pencil tip relative to said collet induces a lead gripping force of said collet against the lead;

first spring means for biasing said collet rearwardly in a second direction opposite to said first direction relative to said collet receiver tube;

second spring means for biasing said collet receiver tube rearwardly in said second direction relative to said casing;

actuation button means mounted on said casing;

cylindrical pusher means longitudinally movably mounted within said casing for advancing said collet and said collet receiver tube towards said pencil tip, said pusher means being connected to said actuation button means;

third spring means for biasing said pusher means rearwardly in said second direction;

engagement means for causing said collet and said collet receiver tube to advance together in said first direction towards said pencil tip until collet receiver tube abuts against a part of said casing when an axial thrust is applied through said button means to said pusher means, and for causing said collet to advance further in said first direction after the forward movement of said collet receiver tube is restricted by such abutment, while enabling said collet receiver tube to be moved by said second spring means in said second direction when the forward thrust is continued, thereby preventing said collet receiver tube from drawing the lead back into the casing upon release of the forward thrust, said engagement means comprising a resilient member extending towards said pencil tip from said pusher means, said resilient member having a shoulder for abutment with said collet receiver tube, thereby advancing said collet receiver tube towards said pencil tip and then releasing the abutment to permit said collet receiver tube to move rearwardly relative to said collet in said second direction; and said conical tip piece having a rearwardly projecting portion having a rearwardly tapered outer surface, and said collet having a forwardly projecting portion having a forwardly flared inner surface, whereby when said collet is fully advanced towards said pencil tip, said projecting portion of the collet slides on said outer surface of said projecting portion of the conical tip piece so that said collet is opened to permit a new lead to be dropped through the opened collet.

* * * * *